United States Patent [19]

Nakamura et al.

[11] Patent Number: 4,619,603

[45] Date of Patent: Oct. 28, 1986

[54] COMBUSTION CYLINDER CONSTRUCTION FOR OIL BURNER

[75] Inventors: Kazuharu Nakamura, Nagoya; Yutaka Nakanishi, Kounan, both of Japan

[73] Assignee: Toyotomi Kogyo Co., Ltd., Tokyo, Japan

[21] Appl. No.: 698,473

[22] Filed: Feb. 5, 1985

[30] Foreign Application Priority Data

Feb. 9, 1984 [JP] Japan ..... 59-22395

[51] Int. Cl.[4] ..... F23D 5/00

[52] U.S. Cl. ..... 431/201; 431/198; 431/200; 431/309; 431/344; 126/96

[58] Field of Search ..... 431/195–201, 431/301, 302, 304–308, 279, 284, 287; 126/96, 45

[56] References Cited

U.S. PATENT DOCUMENTS 4,390,003 6/1983 Nakamura et al. ..... 126/96

4,484,886 11/1984 Nakamura et al. ..... 126/96

*Primary Examiner*—James C. Yeung

*Attorney, Agent, or Firm*—Pollock, Vande Sande & Priddy

[57] ABSTRACT

A combustion cylinder construction for an oil burner is disclosed which is adapted to adjust combustion while preventing the adhesion of soot, moisture and the like on the inner surface of a heat-permeable cylinder to keep it clean during combustion. The combustion cylinder construction includes a first heat-permeable cylinder and a second heat-permeable cylinder supported on the first heat-permeable cylinder with a gap being defined therebetween which serves to introduce air from the exterior therethrough to the overall inner surface of the second heat-permeable cylinder.

21 Claims, 2 Drawing Figures

COMBUSTION CYLINDER CONSTRUCTION FOR OIL BURNER

BACKGROUND OF THE INVENTION

1. Field of the Invention

This invention relates to an improvement in a combustion cylinder construction which is adapted to be used for an oil burner of the type of radiating heat rays from an outer cylindrical member of a double combustion cylinder red-heated and radiating light rays and heat rays from a white-yellow flame formed at a flame spreading means arranged in a combustion chamber, and more particularly to such a combustion cylinder construction constructed to allow combustion air to be fed from a space between the outer cylindrical member and a heat-permeable cylinder to the flame spreading means.

2. Description of the Prior Art

A combustion cylinder construction has been extensively used for an oil burner which is constructed in such a manner that a top plate of an outer cylindrical member acts also as a bottom plate of a combustion chamber having a flame spreading means arranged therein and combustion air to be fed to the outside of the flame spreading means is introduced from a space between the outer cylindrical member and a heat-permeable cylinder. Such a conventional combustion cylinder construction has an advantage that an outer wall of the combustion chamber may be formed integral with the heat-permeable cylinder, because the construction does not require the introduction of combustion air from the exterior thereof. However, in the construction, the wall of the combustion chamber or the upper portion of a heat-permeable cylinder is adhered thereto whity fine particles resulting from the combustion of impurity contained in fuel oil and/or fine particles of carbon generated due to the incomplete combustion to substantially reduce efficiency in heat radiation through the heat-permeable cylinder. In order to avoid such adhesion, the construction is constructed to pass air through the overall inner surface of the wall of the combustion chamber to prevent the fine particles from contacting with the inner surface. This is typically carried out by extending the top plate of the outer cylindrical member in proximity to the heat-permeable cylinder to form an annular gap between the heat-permeable cylinder and the top plate and allowing a part of combustion air to upward flow from the space between the outer cylindrical member and the heat-permeable cylinder through the gap along the overall inner surface.

However, the conventional combustion cylinder construction adapted to feed combustion air from the space between the outer cylindrical member and the heat-permeable cylinder as described above has an important disadvantage that the maximum combustion and the control of combustion are substantially restricted, as compared with a combustion cylinder construction which is adapted to introduce combustion air from the exterior thereof directly to a flame spreading means.

More particularly, a draft in a combustion cylinder means of such a multi-cylinder combustion construction as described above is varied depending upon the combustion in the construction, whereas a draft in a combustion chamber defined above the combustion cylinder means or in the upper portion of the construction is most predominantly generated near a flame spreading means and also varied depending upon the combustion in the construction. Thus, it will be noted that a draft in the construction has a correlation with the variation in heat value at the time of adjusting the combustion, resulting in normal combustion being kept within a certain range even when the adjustment of combustion is carried out. A draft in the portion of the combustion chamber except the vicinity of the flame spreading means cannot be substantially varied depending upon combustion in the construction, as compared with those in the combustion cylinder and near the flame spreading means. Thus, air fed from a slit formed at the bottom plate of the combustion cylinder or the gap between the top plate of the outer cylindrical member and the heat-permeable cylinder toward the inner surface of the cylindrical wall of the combustion chamber is slowly varied with respect to the variation of combustion in the construction. Such a draft in the combustion chamber significantly affects a draft in the space between the outer cylindrical member and the heat-permeable cylinder via the slit of the bottom plate of the combustion chamber to cause the latter draft to be kept still strong even when the rate of combustion is small. This also does not allow a desired draft to be obtained at the maximum combustion.

SUMMARY OF THE INVENTION

The present invention has been made in view of the foregoing disadvantages of the prior art.

Accordingly, it is an object of the present invention to provide a combustion cylinder construction for an oil burner which is capable of widely carrying out the adjustment of combustion while preventing the adhesion of fine particles such as soot, moisture and the like on the inner surface of a heat-permeable cylinder to keep it constantly clean during the combustion.

It is another object of the present invention to provide a combustion cylinder construction for an oil burner which is capable of readily accomplishing desired maximum combustion while preventing the adhesion of fine particles on the inner surface of a heat-permeable cylinder.

It is a further object of the present invention to provide a combustion cylinder construction for an oil burner which is capable of exhibiting excellent combustion performance and reliability in the operation while preventing the adhesion of fine particles on the inner surface of a heat-permeable cylinder.

It is still a further object of the present invention to provide a combustion cylinder construction for an oil burner which is carrying out the above-mentioned objects with a simple structure.

In accordance with the present invention, there is provided a combustion cylinder construction for an oil burner comprising:

a multi-cylinder combustion means comprising an inner cylindrical member, an outer cylindrical member and a first heat-permeable cylinder disposed to surround the cylindrical members;

a combustion chamber provided above the multi-cylinder combustion means so as to be communicated therewith;

a flame spreading means arranged in the combustion chamber and above the inner cylindrical member; and a second heat-permeable cylinder provided above the first heat-permeable cylinder to constitute a cylindrical side wall of the combustion chamber, the second heat-permeable cylinder being formed to have a diameter larger than that of the first heat-permeable cylinder and arranged to be substantially concentrical with the first heat-permeable cylinder;

the outer cylindrical member having a top plate which has a central opening and serves also as a bottom wall of the combustion chamber;

the outer cylindrical member being formed with a plurality of upper, middle and lower through-holes;

the top plate of the outer cylindrical member outward extending past the upper end of the first heat-permeable cylinder to the lower end of the second heat-permeable cylinder;

the top plate of the outer cylindrical member being formed at the portion thereof between the first and second heat-permeable cylinders with a plurality of through-holes which allow air to be fed from the exterior of the combustion cylinder construction therethrough to the overall inner surface of the second heat-permeable cylinder.

In accordance with the present invention, there is also provided a combustion cylinder construction for an oil burner of the heat-radiation type comprising:

a multi-cylinder combustion means comprising an inner cylindrical member, an outer cylindrical member and a first heat-permeable cylinder disposed to surround the cylindrical members, which are arranged to be substantially concentrical with one another;

a combustion chamber provided above the multi-cylinder combustion means so as to be communicated therewith;

a flame spreading means arranged in the combustion chamber and above the inner cylindrical member; and a second heat-permeable cylinder provided above the first heat-permeable cylinder to constitute a cylindrical side wall of the combustion chamber, the second heat-permeable cylinder being formed to have a diameter larger than that of the first heat-permeable cylinder and arranged to be substantially concentrical with the first heat-permeable cylinder;

the outer cylindrical member having an annular top plate which has a central opening and serves also as a bottom wall of the combustion chamber;

the outer cylindrical member being formed with a plurality of upper, middle and lower through-holes, the upper and middle through-holes having a size larger than the lower through-holes and the top plate of the outer cylindrical member extending above the inner cylindrical member and being upward spaced from the inner cylindrical member, so that gas of a high temperature formed in a space between the inner and outer cylindrical members is guided through the middle through-holes to the outer surface of the outer cylindrical member and combustion air to be fed to the outside of the flame spreading means is guided from a space between the outer cylindrical member and the heat-permeable cylinder through the upper through-holes to the flame spreading means;

the top plate of the outer cylindrical member outward extending past the upper end of the first heat-permeable cylinder to the lower end of the second heat-permeable cylinder and supporting the second heat-permeable cylinder thereon;

the top plate of the outer cylindrical member being formed at the portion thereof between the first and second heat-permeable cylinders with a plurality of through-holes which are annularly arranged in the circumferential direction of the top plate to allow air to be fed from the exterior of the construction therethrough to the overall inner surface of the second heat-permeable cylinder.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which.

DETAILED DESCRIPTION OF THE PREFERRED EMBODIMENT

Figure 1:
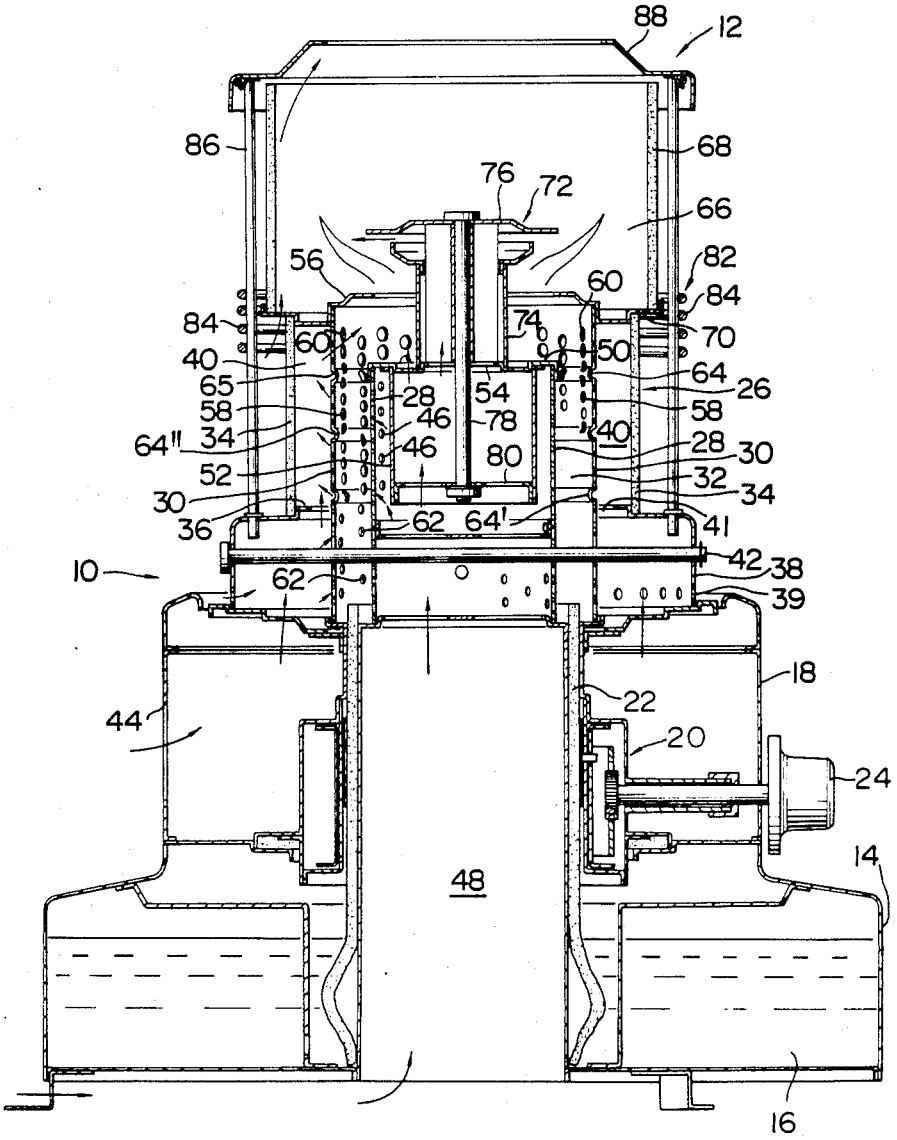
FIG. 1 is a vertical sectional view showing an oil burner which has one embodiment of a combustion cylinder construction according to the present invention incorporated therein.

FIG. 1 illustrates an oil burner of the heat radiation type which has an embodiment of a combustion cylinder construction according to the present invention incorporated therein. The oil burner shown in FIG. 1 is a red-hot type oil fired space heater, however, it should be noted that an oil burner of the heat radiation type in which a combustion cylinder construction of the present invention is adapted to be incorporated is not limited to such an oil fired space heater.

The oil burner generally designated by reference numeral 10 in FIG. 1 is constructed in such a manner as widely known in the art, except a combustion cylinder construction generally indicated by 12.

The oil burner 10 includes an oil tank 14 for storing fuel oil 16 such as kerosene and a wick receiving case 18 communicated with the oil tank 14. In the wick receiving case 18, a wick moving mechanism 20 is provided which is adapted to vertically move a wick 22 through a knob 24.

Figure 2:
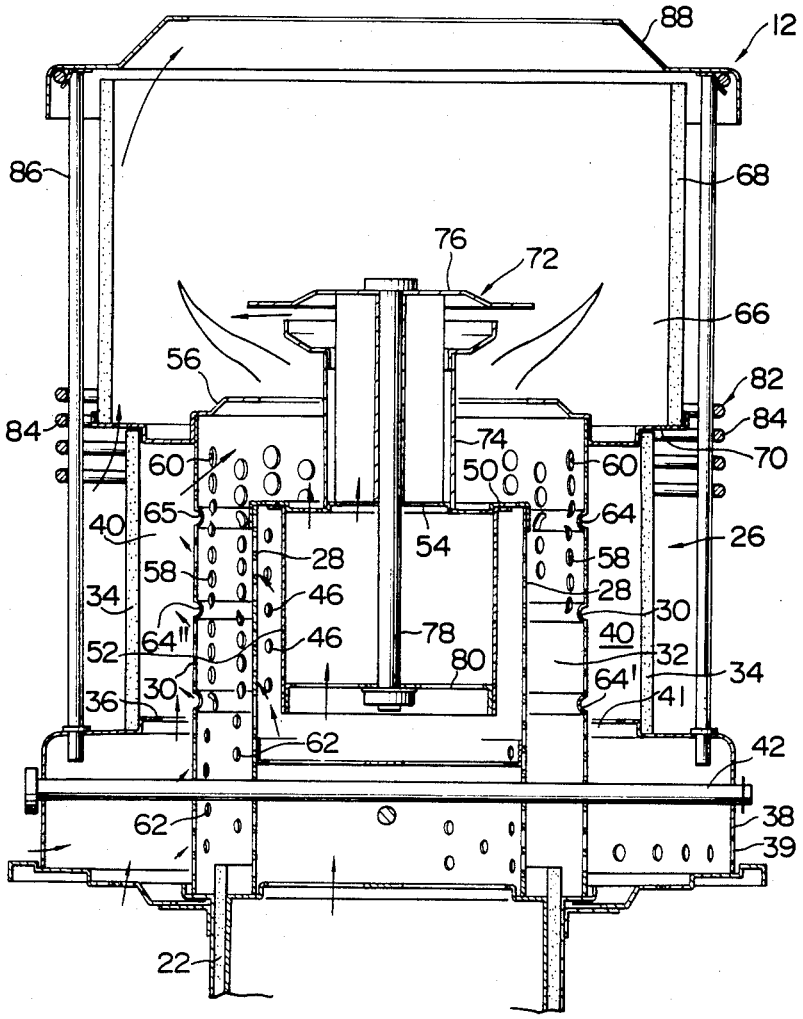
FIG. 2 is an enlarged vertical sectional view showing the embodiment of the combustion cylinder construction shown in FIG. 1.

The combustion cylinder construction 12 of the embodiment is arranged on the wick receiving case 18. The combustion cylinder construction 12 includes a multi-cylinder combustion means 26 including an inner cylindrical member 28 and an outer cylindrical member 30 which are arranged to be substantially concentrical with each other to define a space 32 therebetween. The multi-cylinder combustion means 26 also includes a first heat-permeable cylinder 34 supported on an annular top plate 36 of a base cylinder 38 of the combustion cylinder construction which is arranged on the wick receiving case 18. The heat-permeable cylinder 34 is preferably transparent. The base cylinder 38 is formed at the side wall thereof with holes 39 acting as an air intake means. The first heat-permeable cylinder 34 is arranged to surround the red-heated portion of the outer cylindrical member 30 with a space 40 being defined between the heat-permeable cylinder 34 and the member 30. The base cylinder 38 serves to concentrically support the inner and outer cylindrical members 28 and 30 by means of a cross pin 42 and support the heat-permeable cylinder 34 in a concentrical relationship to the cylindrical members 28 and 30. The annular top plate 36 of the base cylinder 38 acts to control the flow of air upward fed therethrough from the through-holes 39 of the base cylinder 38 and through-holes 44 formed at the side wall of the wick receiving case 20. For this purpose, the annular top plate 36 may be formed with a plurality of through-holes. Alternatively, the annular top plate 36 may be formed to define a gap 41 between the plate 36 and the member 30, as clearly shown in FIG. 2.

The inner cylindrical member 28 is provided with a plurality of through-holes 46 through which a part of air is introduced to the space 32 between the inner and outer cylindrical members 28 and 30 from the lower portion of an internal cylindrical space 48 defined in the oil burner 10 and communicated with the exterior thereof. The inner cylindrical member 28 is also provided with an annular top plate 50 inwardly extending so as to cover the periphery of the top portion of a central cylinder 52 arranged therein. The top plate 50 has a circular opening 54 defined at the central portion thereof. The central cylinder 52 acts to quantitatively control air fed through the through-holes 46 of the inner cylindrical member 28 to the space 32 and guide air to a flame spreading means described hereinafter.

The outer cylindrical member 30 has an annular top plate 56 provided at the upper portion thereof which outward extends beyond the first heat-permeable cylinder 34. The inner end of the top plate terminates substantially above the inner cylindrical member 28. Also, the inner end of the top plate 56 is preferably upward spaced substantially from the inner cylindrical member 28. The outer cylindrical member 30 is also provided with a plurality of through-holes. Through-holes 58 of the member 30 provided above the annular top plate 36 of the base cylinder 38 are larger in size than the through-holes 46 of the inner cylindrical member 28. Preferably, upper through-holes 60 provided near the top plate 56 have a larger size than the middle through-holes 58, and lower through-holes 62 formed at the portion of the member 30 below the top plate 36 of the base cylinder 38 have the substantially same size as the through-holes 46 of the inner cylindrical member 28. The upper and middle through-holes 60 and 58 are preferably formed into an elliptic shape. The lower through-holes 62 act to guide a part of combustion air from the air intake means 39 of the base cylinder 38 and the through-holes 44 of the wick receiving case 18 therethrough to the space 32 between the inner and outer cylindrical members 28 and 30. In the space 32, fuel oil vaporized from the wick 22 is mixed with combustion air introduced via the through-holes 46 and 62 to form combustible gas in the lower portion of the space 32, and at least a part of the so-formed combustible gas is burned in the space 32.

The outer cylindrical member 30 may have a recess 64 semi-circular in section circumferentially provided at the boundary portion between the upper through-holes 62 and the middle through-holes 58. The recess 64 has a plurality of holes 65 provided therethrough. Also, the outer cylindrical member 30 may have a lower recess 64' of the substantially same configuration as the recess 64 provided at the boundary portion between the lower through-holes 62 and the middle through-holes 58 which is also formed with a plurality of through-holes. Further, in the illustrated embodiment, the outer cylindrical member 30 has an intermediate recess 64" semi-circular in section provided at the portion thereof at which the middle through-holes are formed. All the through-holes of the outer and inner cylindrical members may be formed in various shapes such as a slit shape, an elliptic shape or the like as desired, although these are formed in a circular shape in the illustrated embodiment.

Above the multi-cylinder combustion means 26, a combustion chamber 66 is defined. A side wall of the combustion chamber 66 is formed by a second heat-permeable cylinder 68. The second heat-permeable cylinder 68 may be formed of the same material as the first heat-permeable cylinder 34 and is formed to have a diameter larger than the first one 34. The second heat-permeable cylinder 68 is preferably transparent. Alternatively, the second heat-permeable cylinder 68 may be formed of a translucent material different from that of the first heat-permeable cylinder, for example, such as ground glass or the like. The second heat-permeable cylinder 68 is supported on the outer end portion of the top plate 56 of the outer cylindrical member 30 which outwardly extends from the first heat-permeable cylinder 34 so as to be substantially concentrical with the first heat-permeable cylinder 34 with a gap of a suitable interval being formed between the first and second heat-permeable cylinders 34 and 68.

A bottom wall of the combustion chamber is formed by the top plate 56 of the outer cylindrical member 30. The portion of the top plate 56 interposed between the first and second heat-permeable cylinders 34 and 68 is provided with a plurality of through-holes 70 which are arranged in a row in the circumferential direction. The through-holes 70 serve to guide air from the exterior of the oil burner therethrough along the whole inner surface of the second heat-permeable cylinder 68 in the upward direction. Reference numeral 72 designates a flame spreading means arranged in the combustion chamber 66. The flame spreading means 72 includes a cylindrical member 74 supported on the inner end of the annular top plate 50 of the inner cylindrical member 28 so as to upward extend therefrom into the combustion chamber 66 and be communicated with the central cylinder 52, and a flame spreading plate 76 arranged above the cylindrical member 74 so as to cover the member 74 with a space being defined therebetween. In the embodiment illustrated, the plate 76 is supported through a bolt 78 by a perforated plate 80 provided at the lower portion of the central cylinder 52. As is seen from the foregoing, the cylindrical member 74 of the flame spreading means 72 is substantially spaced from the inner end of the top plate 56 of the outer cylindrical member 30 so as to define a large annular gap therebetween. Also, a wide space is preferably defined between the flame spreading plate 76 and the side wall of the combustion chamber 66 or the second heat-permeable cylinder 68 so that a long stable white-yellow flame may be formed at the flame spreading means 72.

Thus, it will be noted that the flame spreading means 72 is communicated at the interior thereof with the central cylinder 52 and at the exterior thereof with the space 40 between the outer cylindrical member 30 and the first heat-permeable cylinder 34 through the through-holes, particularly, the upper through-holes 60 of the outer outer cylindrical member.

Reference numeral 82 designates a heat ray reflection means provided at a low temperature area of the outside of the combustion cylinder construction between the red-heated outer cylindrical member and a white-yellow flame formed at the flame spreading means or in the proximity of the connection between the first and second heat-permeable cylinders 34 and 68. In the illustrated embodiment, the heat ray reflecting means 82 may comprise a plurality of metal wires 84 securely wound on vertical studs 86 which are fixed on the base cylinder 38 so as to support an annular top cover 88 thereon. The metal wires 84 are arranged to be spaced from the heat-permeable cylinders 34 and 68 at fixed intervals. Such construction serves to provide the heat-permeable cylinders with gentle or smooth temperature profiles, to thereby increase the reflecting efficiency and ensure the long and troublefree life of the heat-permeable cylinders.

The manner of operation of the combustion cylinder construction will now be described.

Fuel oil vaporized from the wick 22 is mixed, in the lower portion of the space 32 between the inner and outer cylindrical members 28 and 30, with combustion air supplied thereto from the exterior of the burner 10 through the through-holes 46 of the inner cylindrical member 28 and the lower through-holes 62 of the outer cylindrical member 30 to form combustible gas. When the combustible gas is ignited, a part thereof is burned in the middle and upper portions of the space 32 using combustion air supplied from the through-holes 46 of the inner cylindrical member 28 and the lower through-holes 62 of the outer cylindrical member 30. Such combustion allows the outer and inner cylindrical members 30 and 28 to be heated and produces combustion gas such as carbon dioxide and the like.

Also, the combustion allows fuel oil gas of a high molecular weight obtained by the subsequent vaporization from the wick due to the combustion heat to be decomposed into hydrocarbon gas of a lower molecular weight due to the heat. This results in the volume of gas in the space 32 being rapidly increased, in cooperation with the generation of combustion gas in the space 32. However, a draft is not substantially generated in the space 32 which is sufficient to allow the gas increased in volume to be upward smoothly guided therein. Whereas, a draft in the space 40 between the first heat-permeable cylinder 34 and the outer cylindrical member 30 gradually becomes larger than the draft in the space 32 with the progress of combustion. This allows a large volume of the hydrocarbon gas and combustion gas produced in the space 32 to be readily sucked through the middle through-holes 58 of the outer cylindrical member 30 into the space 40; because the middle through-holes 58 are larger in size than the through-holes 46 of the inner cylindrical member 28, resulting in the flow resistance of the gas passing through the middle through-holes 58 being substantially less. Thus, the fuel oil gas or hydrocarbon gas of a lower molecular weight produced in the space 32 starts to be burned on the outer surface of the outer cylindrical member 30 heated by combustion in the space 32, using combustion air supplied from the exterior of the burner 10 through the holes 39 of the base cylinder 38 and the holes 44 of the wick receiving case 18 to the space 40. The middle and lower semi-circular recesses 64' and 64'' serve to allow the gas in the space 32 to be more smoothly sucked from the space 32 to the space 40 and uniformly guided along the outer surface of the outer cylindrical member 30 in the upward direction.

Combustion gas of a high temperature produced by the combustion carried out on or adjacent to the outer surface of the outer cylindrical member 30 goes up along the outer surface of the outer cylindrical member 30 to uniformly further red-heat the outer surface. Heat rays emitted from the red-heated inner and outer cylindrical member 28 and 30 due to combustion in the spaces 32 and 40 are discharged through the first heat-permeable cylinder 34 to the exterior of the combustion cylinder construction 12. The so-formed combustion gas is guided through the upper through-holes 60 of the outer cylindrical member 30 to the upper part of the space 32 and further to the outside of the flame spreading means 72. Such guide of the combustion gas is more effectively accomplished by the top plate 56 of the outer cylindrical member 30; because the inner end of the top plate 56 terminates substantially above the inner cylindrical member 28 and is substantially upward spaced therefrom, so that an area of a strong negative pressure may be formed in a space above the inner cylindrical member 28. Also, this is further promoted by the upper semi-circular recess 64. More particularly, at least a part of the combustion gas changes the direction of the flow toward the upper recess 64 at the lower portion of the recess 64 and is guided from the through-holes 65 of the recess 64 through the upper portion of the space 32 to the flame spreading means 72.

Whereas, the combustion air in excess introduced into the space 40 strikes upon the top plate 56 of the outer cylindrical member 30 and is guided from the upper through-holes 60 through the upper portion of the space 32 to the flame spreading means 72. As long as such action of the top plate 56 is not substantially disturbed, the portion of the top plate 56 between the first heat-permeable cylinder 34 and the outer cylindrical member 30 may be provided with through-holes. The combustion air supplied from the space 40 and the internal space 48 to the flame spreading means 72 allows incomplete combustion gas and hydrocarbon gas contained in the combustion gas produced in the spaces 32 and 40 and guided to the outside of the flame spreading means 72 in such a manner as described above to be completely burned in the combustion chamber 66 to form a white-yellow flame which obliquely upward extends from the vicinity of the flame spreading means 72. Heat rays generated from the so-formed white-yellow flame are discharged through the second heat-permeable cylinder 68 to the exterior of the combustion cylinder construction 12.

Thus, it will be noted that combustion air to be supplied to the outside of the flame spreading means 72 is adapted to be guided from the space 40 between the first heat-permeable cylinder 34 and the outer cylindrical member 30 thereto without adversely affecting the outer cylindrical member 30 red-heated or deteriorating the red-heating of the outer cylindrical member 30. Thus, the present invention effectively eliminates the supply of combustion air directly from the outside of the heat-permeable cylinder means to the flame spreading means 72.

As described above, in the combustion cylinder construction of the present embodiment, the top plate 56 of the outer cylindrical member 30, which also acts as the bottom wall of the combustion chamber 66 and the partition between the space 40 and the combustion chamber 66, is provided to horizontally extend past the upper end of the first heat-permeable cylinder 34 to the lower end of the second heat-permeable cylinder 68. The portion of the top plate 56 between the first and second heat-permeable cylinders 34 and 68 is provided with a plurality of the through-holes 70 which are arranged in a row in the circumferential direction and serve to guide air from the exterior of the combustion cylinder construction therethrough upward along the entire inner peripheral surface of the second heat-permeable cylinder 68. Thus, during the combustion operation described above, the air from through-holes 70 effectively prevents soot, moisture and the like generated during the combustion from adhering to the inner surface of the heat-permeable cylinder 68, to thereby keep the inner surface constantly clean during the combustion. It will be noted that this air is not substantially utilized for the combustion in the combustion chamber 66 because it is supplied substantially apart from the flame spreading means 72.

As can be seen from the foregoing, the combustion cylinder construction of the present invention is constructed in the manner to allow only air in the space 40 between the first heat-permeable cylinder 34 and the outer cylindrical member 30 to be utilized as combustion air to be supplied directly to the outside of the flame spreading means 72, so that a wide range of combustion may be readily controllably carried out and the maximum combustion may be significantly stably increased. More particularly, the conventional construction of such type excessively pursues a performance over the real capability in order to approach its operational characteristics to a conventional combustion cylinder construction of the second type that combustion air for the outside of a flame spreading means is fed directly from the exterior of the construction, thus, it lacks reliability in operation. However, the combustion cylinder construction of the present invention can exhibit the substantially same performance as the conventional construction of second type, because all combustion air to be supplied directly to the outside of the flame spreading means is introduced from the space between the first heat-permeable cylinder and the outer cylindrical member.

Also, the present invention can effectively prevent fine particles such as soot, moisture and the like from adhering onto the inner surface of the heat-permeable cylinder means to keep it constantly clean during the combustion.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A combustion cylinder construction for an oil burner of the heat radiation type comprising:

a multi-cylinder combustion means including an inner cylindrical member, an outer cylindrical member and a first heat-permeable cylinder disposed to surround said cylindrical members;

a combustion chamber provided above said multi-cylinder combustion means so as to be communicated with said multi-cylinder combustion means;

a flame spreading means arranged in said combustion chamber and above said inner cylindrical member; and a second heat-permeable cylinder provided above said first heat-permeable cylinder to constitute a cylindrical side wall of said combustion chamber, said second heat-permeable cylinder being formed to have a diameter larger than that of said first heat-permeable cylinder and arranged to be substantially concentrical with said first heat-permeable cylinder;

said outer cylindrical member having a top plate which has a central opening and serves also as a bottom wall of said combustion chamber;

said outer cylindrical member being formed with a plurality of upper, middle and lower through-holes;

said top plate of said outer cylindrical member extending outward past the upper end of said first heat-permeable cylinder to the lower end of said second heat-permeable cylinder;

and said top plate of said outer cylindrical member being formed at the portion thereof between said first and second heat-permeable cylinders with a plurality of through-holes which allow air to be fed from the exterior of said combustion cylinder construction therethrough to the overall inner surface of said second heat-permeable cylinder.

2. A combustion cylinder construction as defined in claim 1, wherein said top plate of said outer cylindrical member is upward spaced from the upper end of said inner cylindrical member.

3. A combustion cylinder construction for an oil burner as defined in claim 2, wherein said top plate of said outer cylindrical member terminates at the inner end thereof substantially above said inner cylindrical member.

4. A combustion cylinder construction for an oil burner as defined in claim 1, wherein said upper through-holes of said outer cylindrical member are formed to have a size larger than those of said middle and lower through-holes thereof.

5. A combustion cylinder construction for an oil burner as defined in claim 4, wherein the upper through-holes and the middle through-holes of said outer cylindrical member are formed in an elliptic shape.

6. A combustion cylinder construction for an oil burner as defined in claim 1, wherein said through-holes of said top plate of said outer cylindrical member are annularly arranged in the circumferential direction of said top plate.

7. A combustion cylinder construction for an oil burner as defined in claim 1, wherein said second heat-permeable cylinder is supported on said top plate of said outer cylindrical member.

8. A combustion cylinder construction for an oil burner as defined in claim 1, wherein said outer cylindrical member is formed with first and second recesses in the circumferential direction thereof at the areas thereof between said upper through-holes and said middle through-holes and between said middle through-holes and said lower through-holes, respectively, said recesses each being formed with a plurality of through-holes which are arranged in the circumferential direction of said outer cylindrical member.

9. A combustion cylinder construction for an oil burner as defined in claim 8, wherein said outer cylindrical member is also formed with a third recess in the circumferential direction thereof at the area thereof between said first and second recesses, and said third recess being formed with a plurality of through-holes arranged in the circumferential direction of said outer cylindrical member.

10. A combustion cylinder construction for an oil burner as defined in claim 8 or 9, wherein said recesses each has a semi-circular shape in section.

11. A combustion cylinder construction for an oil burner as defined in claim 1, wherein said first heat-permeable cylinder is supported on a base cylinder which is disposed to surround the portion of said outer cylindrical member at which said lower through-holes are provided.

12. A combustion cylinder construction for an oil burner as defined in claim 11, wherein said base cylinder includes an annular top plate having means for controlling a flow of air fed upward therethrough to a space between said outer cylindrical member and said first heat-permeable cylinder.

13. A combustion cylinder construction for an oil burner as defined in claim 1, wherein said first and second heat-permeable cylinders are transparent.

14. A combustion cylinder construction according to claim 1 which further comprises central means communcated with the exterior of said combustion cylinder construction for guiding a first flow of combustion air internally to said flame spreading means; wherein said central opening of the top plate of said outer cylindrical member guides a second flow of combustion air directly to the outside of said flame spreading means; and wherein said first and second flows of combustion air provide a white-yellow flame at said flame spreading means such that air fed from the exterior of said combustion cylinder construction through said through-holes in the top plate of said outer cylindrical member is not substantially utilized for combustion in said combustion chamber.

15. A combustion cylinder construction according to claim 1 which further comprises base means defining an internal space communicated with the exterior of said combustion cylinder construction, and wherein said inner cylindrical member is provided with a plurality of through-holes through which a flow of air from said internal space is introduced to a space between said inner cylindrical member and outer cylindrical member.

16. A combustion cylinder construction for an oil burner as defined in claim 15, wherein said multi-cylinder combustion means includes central cylinder means for guiding a flow of air internally from said internal space to said flame spreading means, and said central cylinder means comprises a central cylinder arranged to quantitatively control the flow of air through said through-holes of the inner cylindrical member.

17. A combustion cylinder construction for an oil burner as defined in claim 15, wherein the lower through-holes of said outer cylindrical member are formed to have a size smaller than said middle and upper through-holes thereof, and wherein said lower through-holes and the through-holes of said inner cylindrical member are formed to have substantially the same size.

18. A combustion cylinder construction for an oil burner of the heat radiation type comprising:

a multi-cylinder combustion means including an inner cylindrical member, an outer cylindrical member and a first heat-permeable cylinder disposed to surround said cylindrical members;

a combustion chamber provided above said multi-cylinder combustion means so as to be communicated with said multi-cylinder combustion means;

a flame spreading means arranged in said combustion chamber and above said inner cylindrical member;

a second heat-permeable cylinder provided above said first heat-permeable cylinder to constitute a cylindrical side wall of said combustion chamber, said second heat-permeable cylinder being formed to have a diameter larger than that of said first heat-permeable cylinder and arranged to be substantially concentrical with said first heat-permeable cylinder; and, a heat ray reflecting means provided at a low temperature area of said first and second heat-permeable cylinders interposed between two high temperature areas thereof;

said outer cylindrical member having a top plate which has a central opening and serves also as a bottom wall of said combustion chamber;

said outer cylindrical member being formed with a plurality of upper, middle and lower through-holes;

said top plate of said outer cylindrical member having a portion extending outward from the upper end of said first heat-permeable cylinder to the lower end of said second heat-permeable cylinder;

and said top plate of said outer cylindrical member being formed at the portion thereof between said first and second heat-permeable cylinders with a plurality of through-holes which allow air to be fed from the exterior of said combustion cylinder construction therethrough to the overall inner surface of said second heat-permeable cylinder.

19. A combustion cylinder construction for an oil burner as defined in claim 18, wherein said heat ray reflecting means is arranged at the outside of the boundary area between said first and second heat-permeable cylinders.

20. A combustion cylinder construction for an oil burner as defined in claim 18 or 19, wherein said heat ray reflecting means comprises a plurality of metal wires wound on a supporting means disposed around said heat-permeable cylinders.

21. A combustion cylinder construction for an oil burner of the heat radiation type comprising:

a multi-cylinder combustion means comprising an inner cylindrical member, an outer cylindrical member and a first heat-permeable cylinder disposed to surround said cylindrical members, which are arranged to be substantially concentrical with one another;

a combustion chamber provided above said multi-cylinder combustion means so as to be communicated therewith;

a flame spreading means arranged in said combustion chamber and above said inner cylindrical member; and a second heat-permeable cylinder provided above said first heat-permeable cylinder to constitute a cylindrical side wall of said combustion chamber, said second heat-permeable cylinder being formed to have a diameter larger than that of said first heat-permeable cylinder and arranged to be substantially concentrical with said first heat-permeable cylinder;

said outer cylindrical member having an annular top plate which has a central opening and serves also as a bottom wall of said combustion chamber;

said outer cylindrical member being formed with a plurality of upper, middle and lower through-holes, said upper and middle through-holes having a size larger than said lower through-holes and said top plate of said outer cylindrical member extending above said inner cylindrical member and being upward spaced from the upper end of said inner cylindrical member, so that gas of a high temperature formed in a space between said inner and outer cylindrical members is guided through said middle through-holes to the outer surface of said outer cylindrical member and combustion air to be fed directly to the outside of said flame spreading means is guided from a space between said outer cylindrical member and said first heat-permeable cylinder through said upper through-holes to the flame spreading means;

said top plate of said outer cylindrical member extending outward from the upper end of said first heat-permeable cylinder to the lower end of said second heat-permeable cylinder and supporting said second heat-permeable cylinder thereon;

and said top plate of said outer cylindrical member being formed at the portion thereof between said first and second heat-permeable cylinders with a plurality of through-holes which are annularly arranged in the circumferential direction of said top plate to allow air to be fed from the exterior of said combustion cylinder construction therethrough to the overall inner surface of said second heat-permeable cylinder.

* * * * *